US005370256A

United States Patent [19]

Fourie et al.

[11] Patent Number: 5,370,256

[45] Date of Patent: Dec. 6, 1994

[54] COLLAPSIBLE CONTAINER

[75] Inventors: Johannes J. Fourie, 33 Malieveld Street, Sabie, Eastern Transvaal, South Africa; Gert J. R. Kruger, Magwazi, South Africa

[73] Assignee: Johannes Jacobus Fourie, Sabie, South Africa

[21] Appl. No.: 494,275

[22] Filed: Mar. 15, 1990

[30] Foreign Application Priority Data

Mar. 15, 1989 [ZA] South Africa ..... 89/1957
Nov. 9, 1989 [ZA] South Africa ..... 89/8556

[51] Int. Cl.[5] ..... B65D 88/52

[52] U.S. Cl. ..... 220/6; 220/4.28; 220/1.5; 220/8; 206/600

[58] Field of Search ..... 220/8, 6, 4.33, 4.31, 220/4.28, 1.5, 666, 680, 720, 351, 345; 217/12 R, 13, 15, 59, 57, 56, 62, 43 R, 45, 47; 206/386, 600

[56] References Cited

U.S. PATENT DOCUMENTS

| | | | |
|---|---|---|---|
| 2,952,379 | 9/1960 | Potter | 206/600 |
| 3,850,295 | 11/1974 | Black . | |
| 3,966,075 | 6/1976 | Schultz | 220/1.5 |
| 4,151,925 | 5/1979 | Glassmeyer | 220/1.5 |
| 4,184,599 | 1/1980 | Drake et al. . | |
| 4,805,794 | 2/1989 | Tsuchiya et al. | 220/8 |

FOREIGN PATENT DOCUMENTS

| | | | |
|---|---|---|---|
| 159744 | 11/1954 | Australia . | |
| 1159379 | 12/1983 | Canada | 206/600 |
| 0048577 | 3/1982 | European Pat. Off. . | |
| 21757 | 8/1961 | Germany . | |
| 70276 | 12/1969 | Germany . | |
| 336370 | 10/1930 | United Kingdom . | |
| 373461 | 5/1932 | United Kingdom . | |
| 488435 | 7/1938 | United Kingdom | 220/8 |
| 1257532 | 12/1971 | United Kingdom . | |
| 2053143 | 6/1980 | United Kingdom . | |
| 2179629 | 3/1987 | United Kingdom . | |

OTHER PUBLICATIONS

GB 2039850—Sea Containers Ltd. *Abstract*.
GB 1555669—Silimpianti Spa *Abstract*.
GB 1517312—F E Tattam *Abstract*.
US 4771906—Gebr. Hennig BmgH *Abstract*.
US 4090659—Establissements Larousse *Abstract*.
US 3613931—P Schifferle *Abstract*.
US 3514030—Caroll Container Corp. *Abstract*.
US 3481457—Overton Container Corp. *Abstract*.
US 3439862—Overton Container Corp. *Abstract*.
EP 73357—Nespak Spac *Abstract*.
EP 67323—U W Friedrich *Abstract*.
DE 1298440—P Schifferle *Abstract*.
FR 2233237—D Campiche *Abstract*.

*Primary Examiner*—S. Castellano
*Attorney, Agent, or Firm*—Browdy and Neimark

[57] ABSTRACT

A collapsible container comprises a rectangular base 11, two end walls 12, 13 mounted to two opposed ends of the base by means of hinge 14 and two separate side walls 15 and 16 mountable on base 11 to rise therefrom. Each wall comprise two wall members 12.1 and 12.2 slidingly connected to one another so that the members may slidingly be manipulated to adjust the height of the wall. The container also comprises a lid 17 removably mountable on the walls.

10 Claims, 10 Drawing Sheets

COLLAPSIBLE CONTAINER

BACKGROUND OF THE INVENTION

1. Technical Field

This invention relates to containers and more particularly to re-usable, collapsible containers.

2. Prior Art

Applicant is aware of the known permanently assembled wooden crates which are used for holding industrial articles such as machinery, while transporting them from a source to a destination. These crates are not collapsible nor adjustable in size and furthermore, they normally are used only once, after which they are destroyed.

OBJECT AND SUMMARY OF THE INVENTION

It is an object of the present invention to provide an alternative container with which the applicant believes the aforementioned disadvantages will at least be alleviated. It is a further object of the invention to provide a container with exceptional rigidity and strength characteristics.

According to the invention a collapsible container comprises:

a base;

a plurality of walls, each having a width and a height dimension;

the walls being erectable on the base to rise therefrom;

each wall comprising at least two wall members slidingly connected to one another so that the members may slidingly be manipulated to adjust the height of the wall; and a lid mountable on the walls to close the container.

Thus, with the apparatus according to the invention a container, the height of which is adjustable, may be formed. After use of the container, it is knocked down again so that it may be transported back to the source, re-assembled and used again.

It will be appreciated that in its collapsed form, with the walls lying flat between the base and lid, the container takes up much less space than in its assembled form. Typical apparatus according to the invention may be used to assemble a container with a length of 2250 mm, a width of 1930 mm and a height adjustable between 1200 and 2000 mm. It has been found that in their collapsed form approximately seventy of these containers fit into a single twelve meter ship container.

The base is preferably rectangular and two end walls are hinged to two opposed ends of the base so that they are movable between a first position wherein they lie substantially flat on the base and a second position wherein they rise from the base.

Also in the preferred embodiment, two separate side walls are mountable on the base between the end walls.

The base preferably comprises a pallet.

Each wall comprises two rectangular wall members, each wall member including a frame comprising a plurality of spaced posts cladded with a sheet, the posts of the one member being telescopically movable in the corresponding posts of the other member so that the members may slidingly be manipulated relative to one another to adjust the height of the wall.

The posts may define spaced apertures and the two members may be locked in a desired position relative to one another by means of locking means extending through registering apertures in the telescopic posts.

The lid is securable to the side walls by means of nuts and bolts.

In the collapsed condition the end walls are folded down onto the base to lie adjacent one another, the side walls are located on the end walls and the lid is located on the side walls and secured to the base by means of a formation extending between the lid and the base.

The formation preferably comprises a pillar securable to the base by means of the nuts and bolts for mounting the side walls on the base in the assembled condition and to the lid by the nuts and bolts for mounting the lid on the side walls in the assembled condition.

BRIEF DESCRIPTION OF THE DRAWINGS

The invention will now further be described, by way of example only, with reference to the accompanying diagrams wherein.

DETAILED DESCRIPTION OF THE PREFERRED EMBODIMENT(S) OF THE INVENTION

Figure 1:
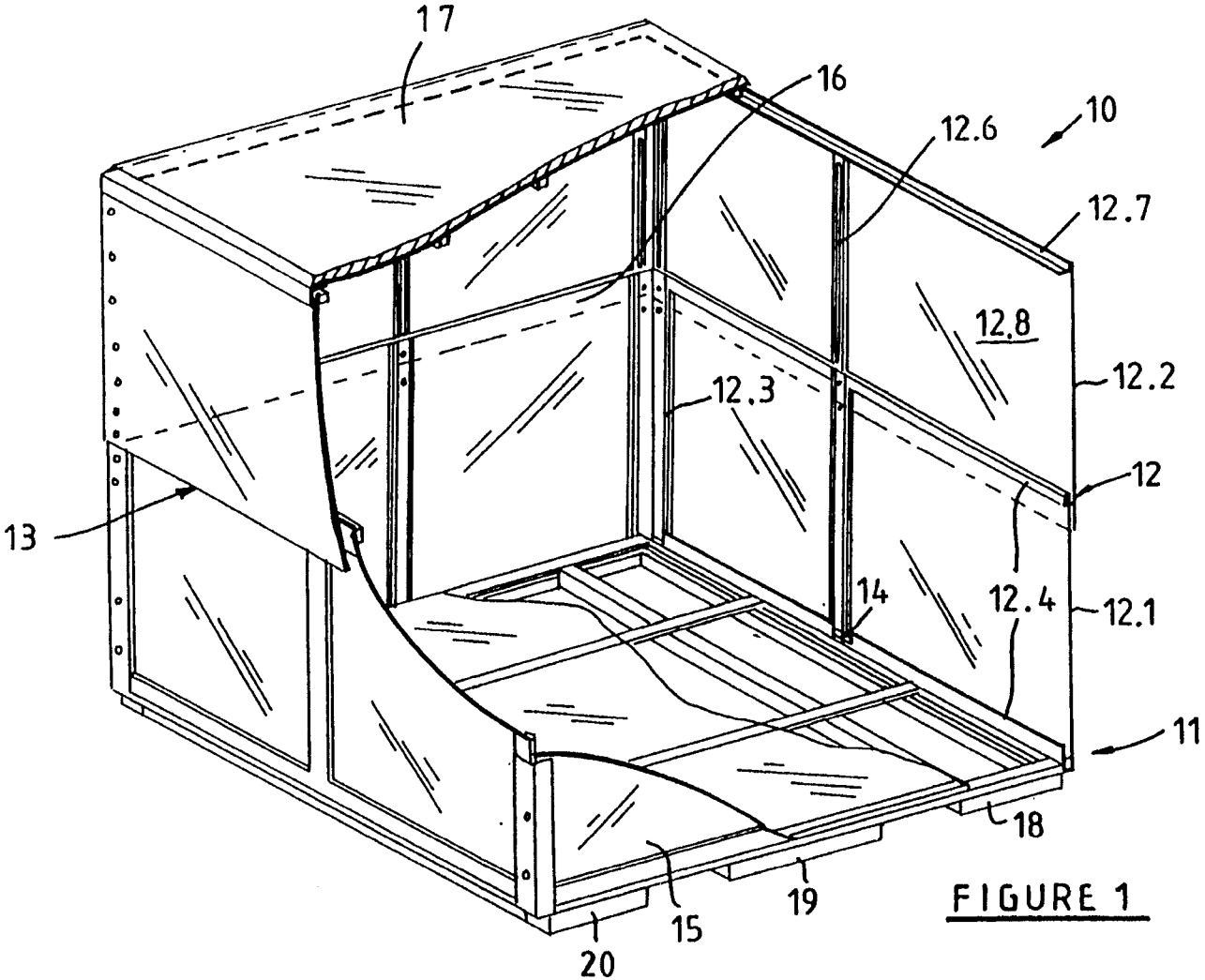
FIG. 1: is a diagrammatic perspective view, partially broken away, of a collapsible container according to the invention in its assembled condition.

A collapsible container 10 according to the invention is shown in its assembled condition, in FIG. 1 and in its folded down or knocked down condition, in FIG. 3.

Referring firstly to FIG. 1, the container 10 comprises a rectangular base 11 in the form of a pallet, two opposed end walls 12, 13 mounted on base 11 by hinges 14, two separate side walls 15 and 16 removably mountable on base 11 and a lid 17 removably mountable on upstanding walls 12, 13, 15 and 16.

Walls 12, 13, 15 and 16 are substantially similar in configuration. Each wall comprises two rectangular planar members, which are designated by reference numerals 12.1 and 12.2, respectively in the case of wall 12. The members are slidably connected to one another and manipulatable between a first configuration (see wall 13 in FIG. 2) wherein the planar surfaces of the members face one another and one or more extended positions (see wall 12 in both FIGS. 1 and 2) wherein the two members are located in partially overlapping or juxtaposition relative to one another.

Figure 4:
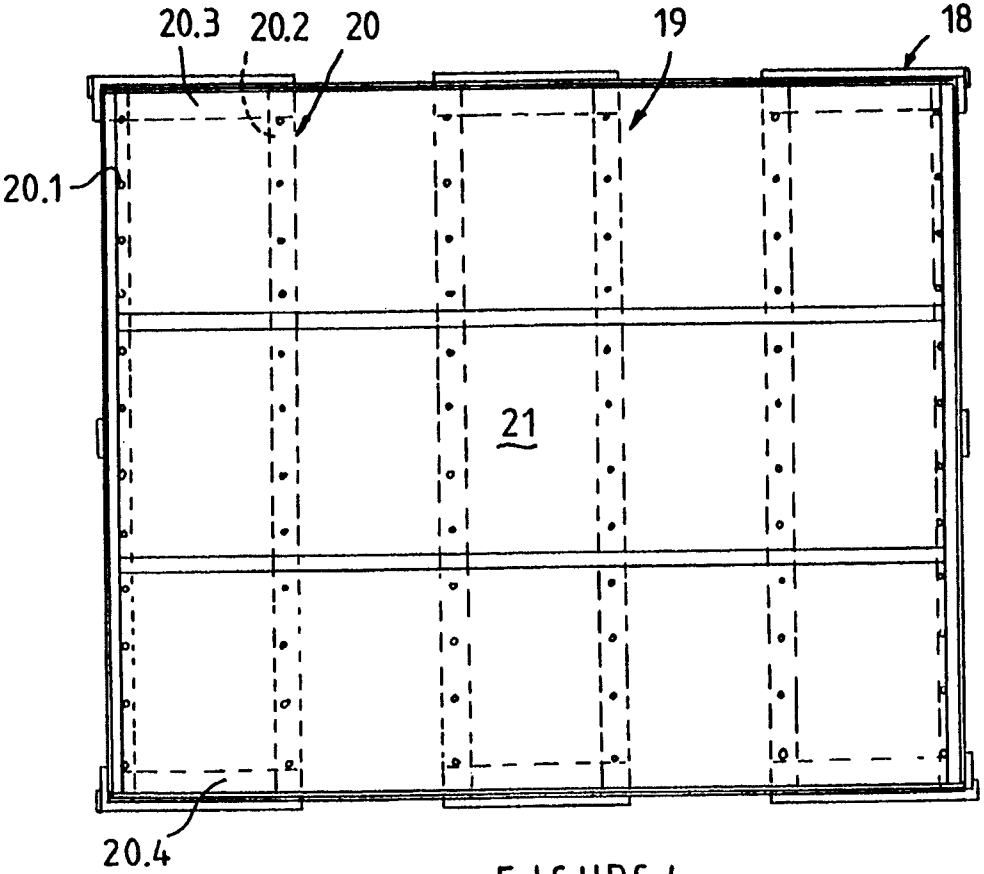
FIG. 4: is a plan view of the base of the container according to the invention.

As shown in FIG. 4 the base 11 comprises three rectangular formations 18 to 20, each made of rectangular tubing. As shown with reference to formation 20, each formation is made of two longer tubing members or limbs 20.1 and 20.2 and two shorter members or limbs 20.3 and 20.4. A steel sheet 21 is riveted to these formations to provide a floor for the container 10.

Figure 5A:
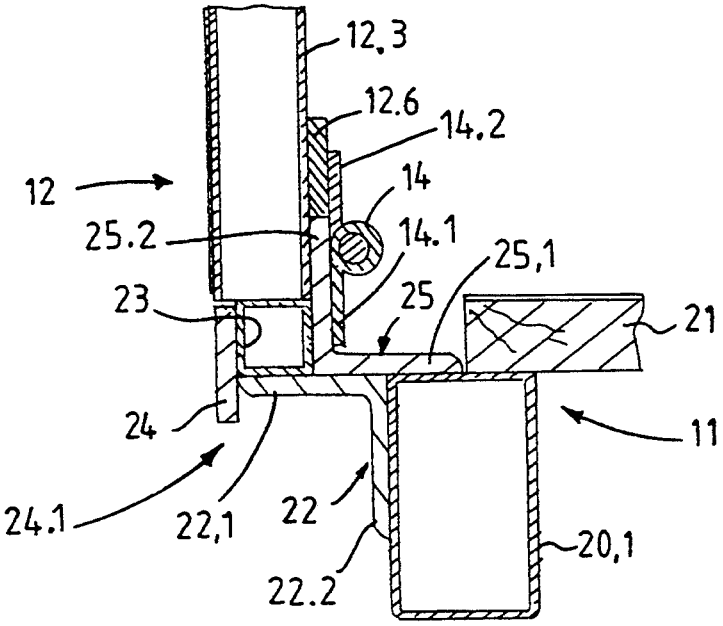
FIG. 5*a*: is a diagrammatic broken away sectional view of an end wall of the container hinged to the base and in an upright position.
Figure 5B:
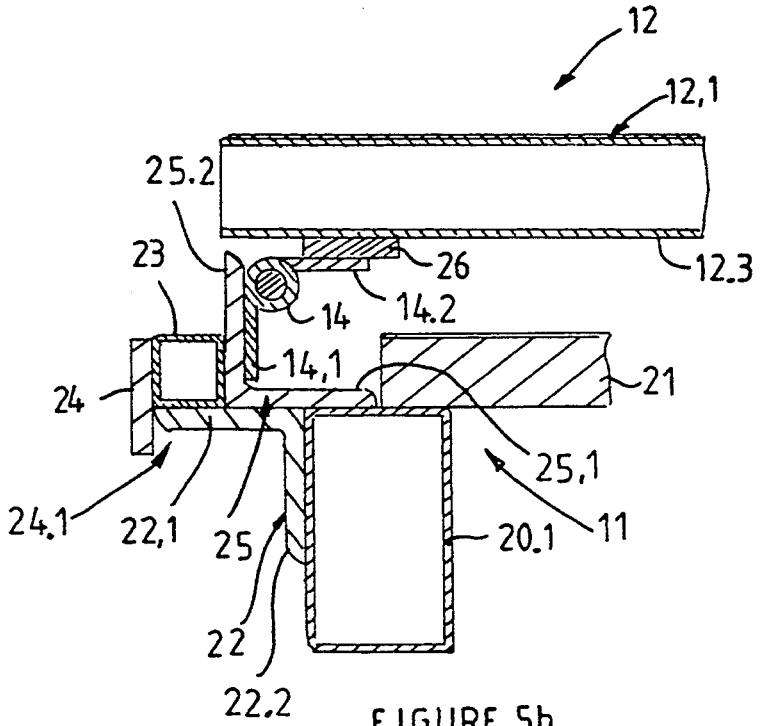
FIG. 5*b*: is a view similar to FIG. 5*a*, but with the end wall in a folded down position.

As shown in FIGS. 1, 5*a* and 5*b*, walls 12 and 13 are mounted on base 11 by means of hinges 14. A first elongate right angled steel member 22 is welded to limb 20.1 of base 11 and a support for the end wall in the form of an elongate square tube 23 is welded on the transversely, outwardly extending leg 22.1 of first right angled member 22. A flat bar 24 is welded to the square member 23 to extend downwardly beyond the transversely extending leg 22.1 of first right angled member 22 thereby defining an inverted channel 24.1 wherein a sling (not shown) of a crane (also not shown) may be received.

A second right angled member 25 is welded in partially overlapping relationship to the first right angled member 22, so that one of its legs extends upwardly, away from member 20.1. As shown in FIGS. 5*a, b* and 9 one leg of hinge 14 is welded to this upstanding leg, while the other is welded to a spacer 26 on a post 12.3 of bottom member 12.1 of end wall 12. This configuration yields a container of exceptional rigidity and strength.

More particularly, first right angled member 22 is secured to limb 20.1 with one leg 22.2 thereof abutting against a side wall of the limb 20.1 and the other leg 22.1 thereof extending outwardly away from the limb 20.1. Second right angled member 25 is also secured to limb 20.1 in partially overlapping relation relative to the first right angled member 22 with one leg 25.1 abutting against a top wall of limb 20.1 and also against leg 22.1 of the first right angled member 22. The other leg 25.2 of second right angled member 25 extends upwardly away from the base. One leg 14.1 of first hinge 14 is secured to the other leg 25.2 of the second right right angled member 25 and the other leg 14.2 of hinge 14 is secured to spacer 26 on end wall 12 of the container. The support 23 for the end wall 12 is thus secured in a rebate defined between the other leg 22.1 of the first right angled member 22 and the other leg 25.2 of the second right angled member 25.

As shown in FIGS. 5*a* and 5*b* end wall 12 is moveable between a first position (shown in FIG. 5*a* ) wherein it rises from base 11 and a second position (shown in FIG. 5*b*) wherein it is folded down onto base 11. End wall 13 is similarly movable between a first position and a second position.

Figure 6:
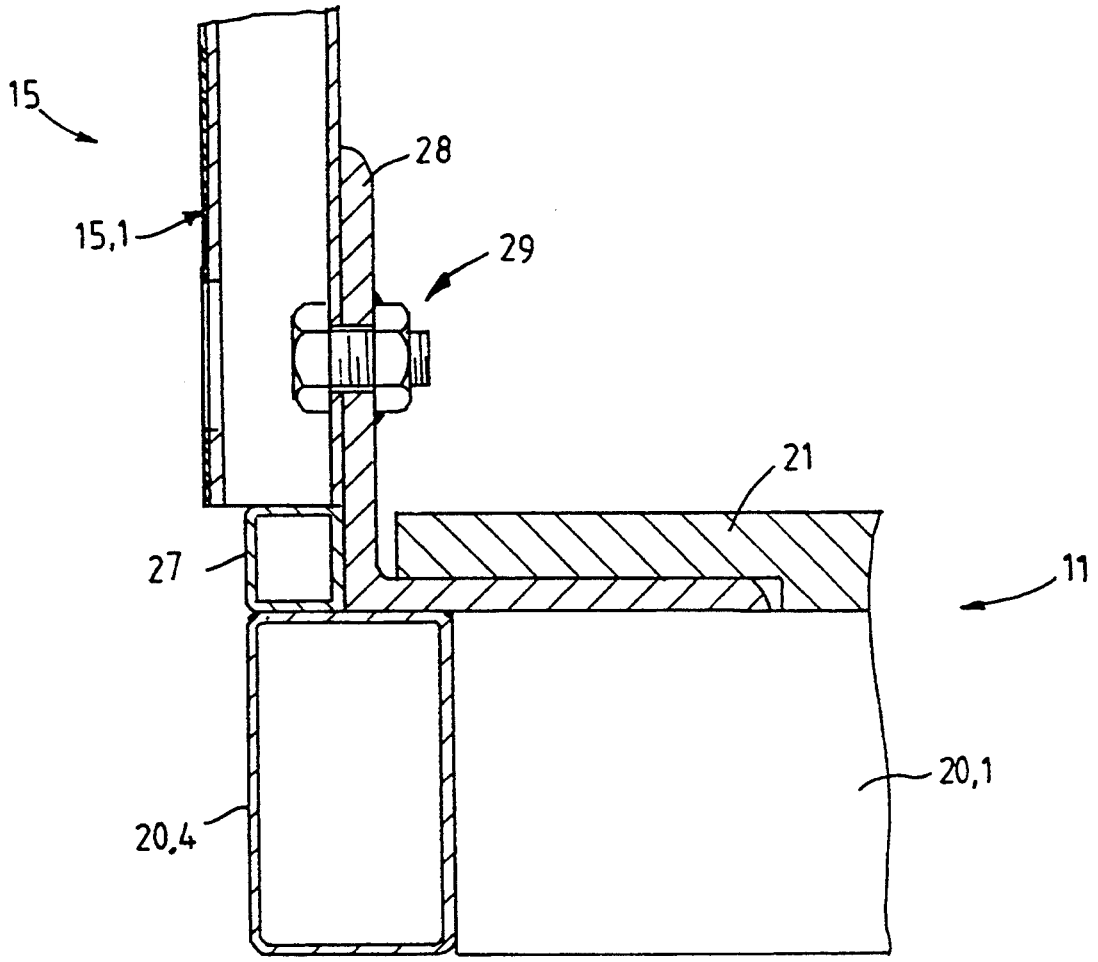
FIG. 6: is a diagrammatic, broken away sectional view of a separate side wall mounted on the base to rise therefrom.

As shown in FIG. 6, side wall 15, which is a separate removable wall, is mounted on base 11 to rise therefrom when the container is in its assembled condition. On rectangular member 20.4 of formation 20 of base 11 there is welded an elongate square tube 27. A right angled member 28 is welded on member 20.4 with one of its legs extending upwardly away from member 20.4. Bottom member 15.1 of side wall 15 is secured to this leg of member 28 by means of nut and bolt 29. Side wall 16 is similarly mountable on base 11 on the opposite side thereof.

Though not clearly shown in the diagrams, square members 23 in FIGS. 5*a* and 5*a* and 27 in FIG. 6 and their corresponding members along the opposite end and side of the base, form a continuous rectangular formation. Similarly, right angled members 25 and 28 and their corresponding members also extend about the whole periphery of base 11.

Figure 2:
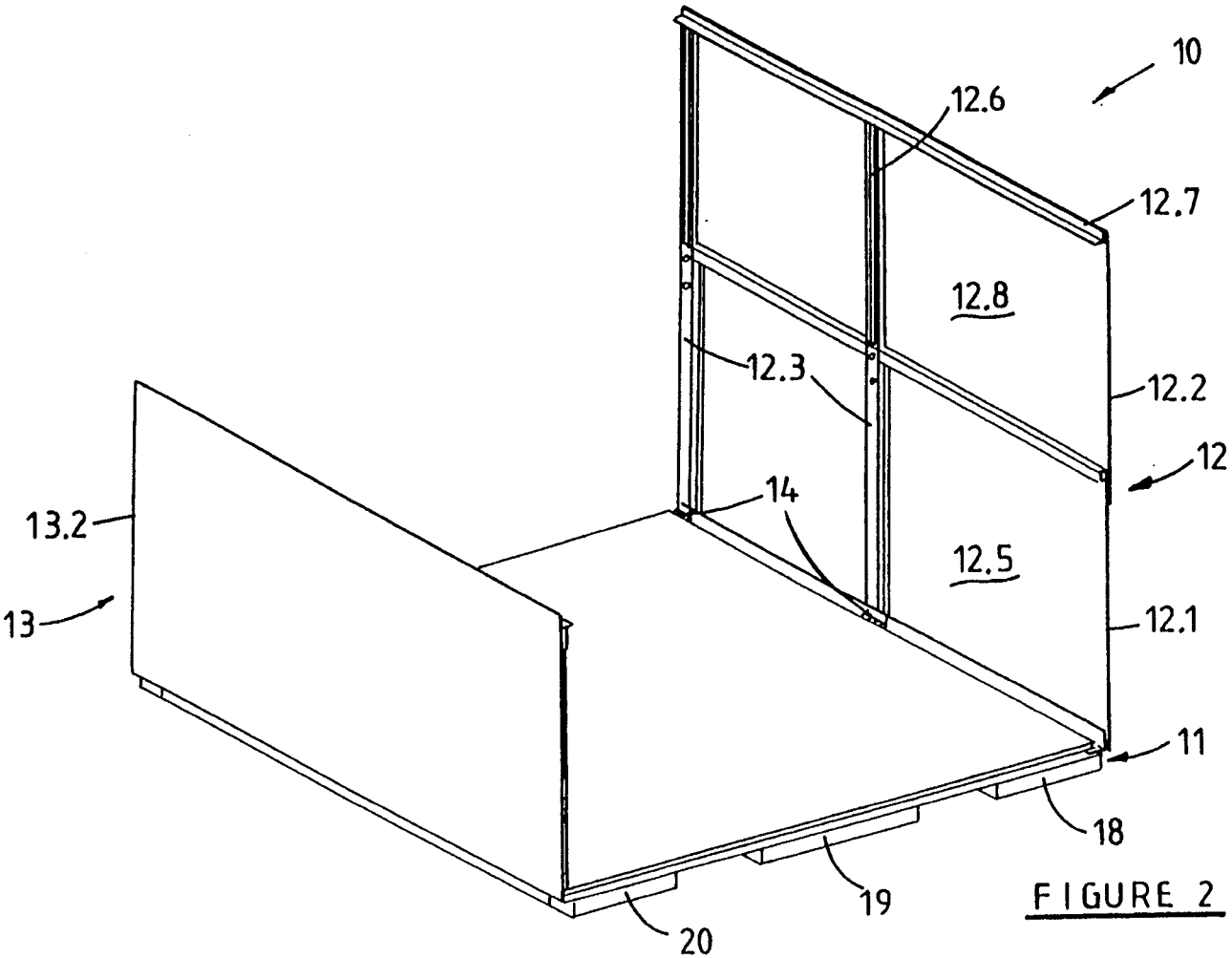
FIG. 2: is a diagrammatic perspective view of the container according to the invention showing only the base and two walls that are adjustable in height.
Figure 8:
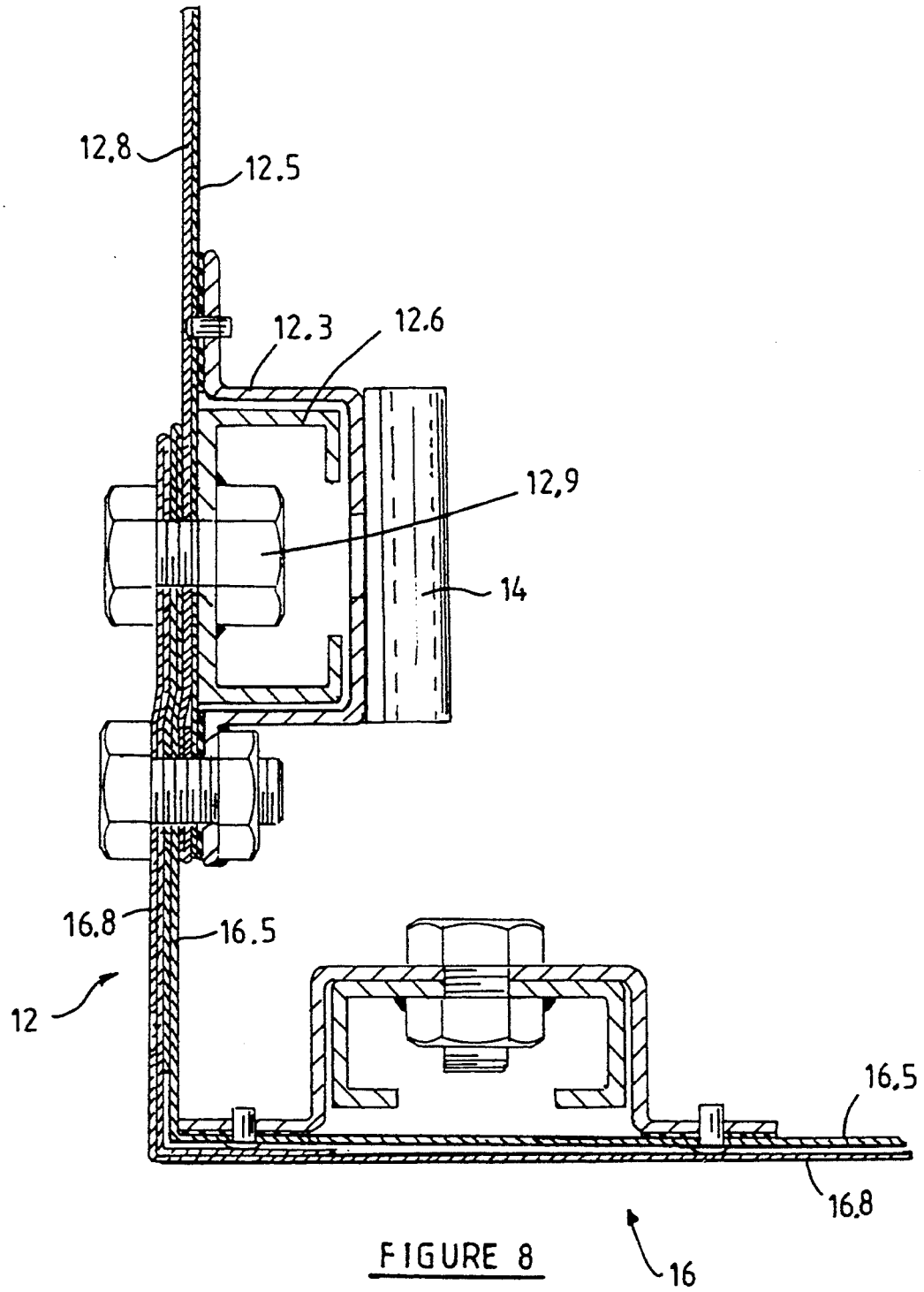
FIG. 8: is a sectional, broken-away view in plan of a corner region where a side wall and an end wall meet in the container's assembled condition.
Figure 9:
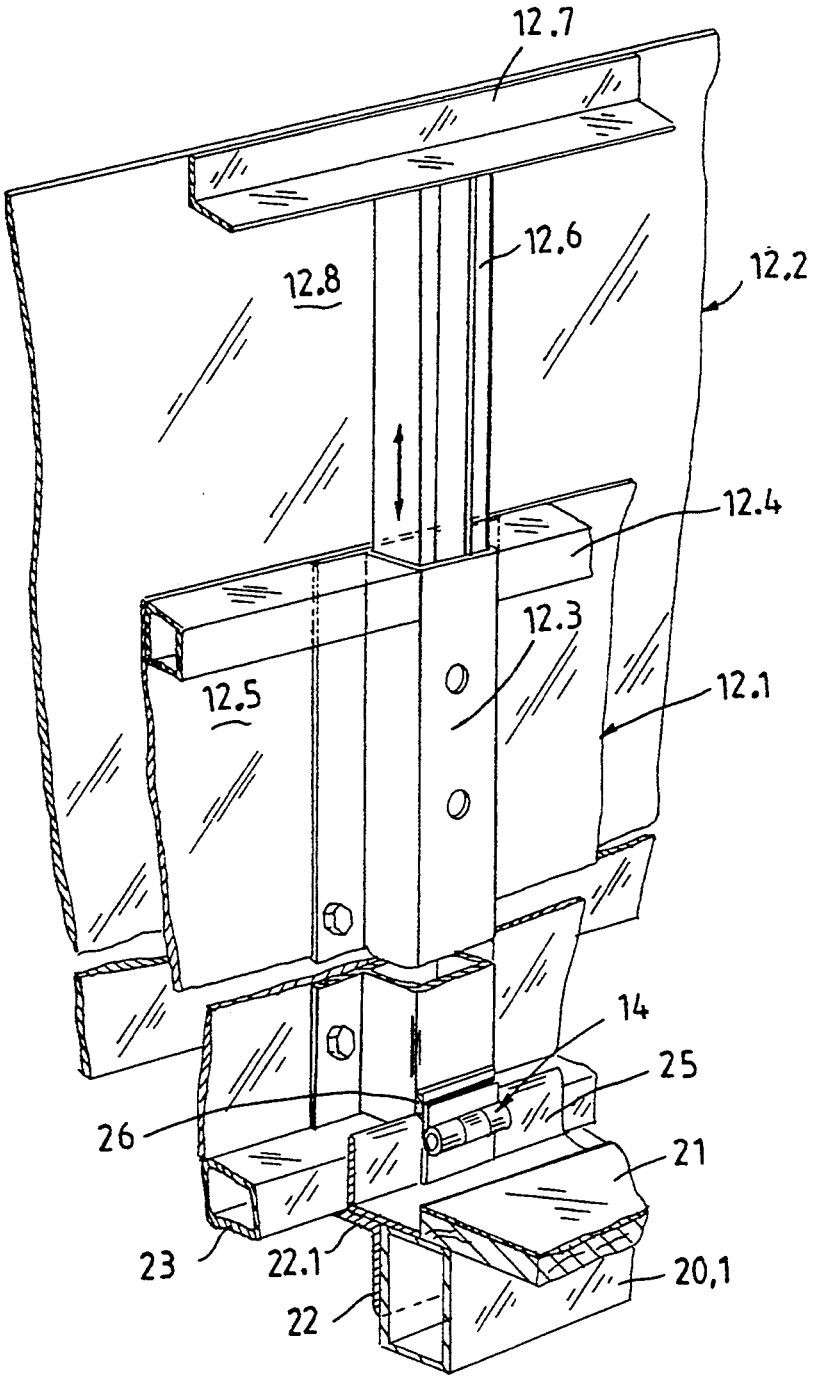
FIG. 9: is a diagrammatic perspective view of two wall members slidably connected to one another so that the height of the wall and of the container in its assembled condition may be adjusted.

The end and side walls 12, 13, 15 and 16 are similar in configuration and only end wall 12 will thus be described in more detail. As best shown in FIGS. 1, 2 and 9, end wall 12 comprises two members, a first member 12.1 hinged to base 11 and a second member 12.2 slidably mounted on first member 12.1. First wall member 12.1 comprises a frame including three parallel, top hat-shaped posts 12.3 (only two of which are shown in FIGS. 1 and 2) and two parallel bars 12.4 extending between the ends of these posts. A steel plate 12.5 is mounted on this frame. The centre post 12.3 of member 12.1 is also shown in FIG. 9, while the post adjacent side wall 16, is shown in FIG. 8.

The second member 12.2 also comprises a frame including three parallel posts 12.6 and an elongate right angled member 12.7 extending between the upper ends of posts 12.6. Posts 12.6 are telescopically movable in posts 12.3 and a steel plate 12.8 is welded to right angled member 12.7 of second wall member 12.2.

One leg of the right angled member 12.7 extends transversely to plate 12.8 and inwardly towards the container. This leg together with other similar legs on the other walls 13, 15 and 16, present a seat for lid 17.

The second member 12.2 is manipulatable relative to the first member 12.1 so that the height of container 10 may be adjusted. As shown in FIG. 8, second member 12.2 is locked in a desired configuration relative to the first member 12.1 by bolts and nuts 12.9 extending through registering holes in posts 12.3 and 12.6.

Figure 7B:
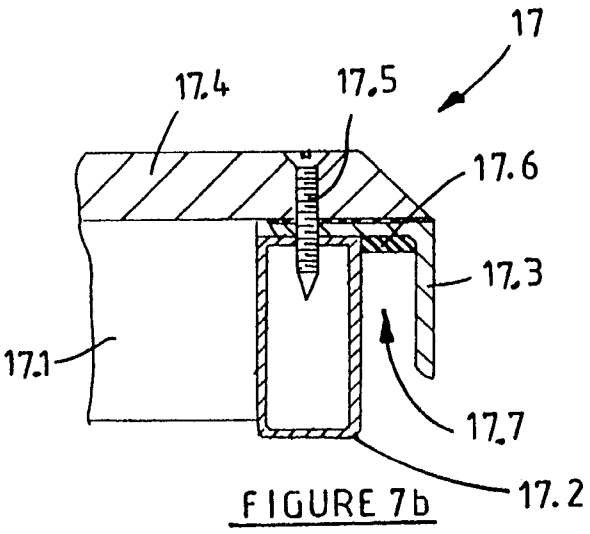
FIG. 7*b*: is a view similar to that in FIG. 7*a*, but of part of the lid only, showing a seal on the lid.
Figure 7A:
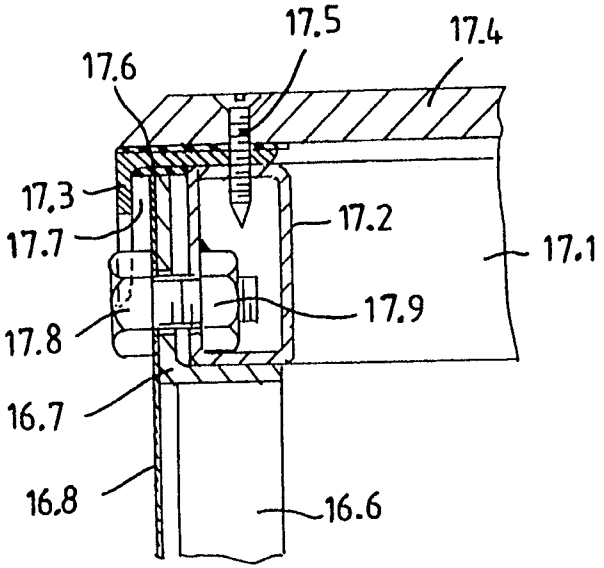
FIG. 7*a*: is a diagrammatic broken away sectional view of a lid of the container mounted on a side wall.

The lid 17 for container 10 is best shown in FIGS. 1, 7*a* and 7*b*. The lid comprises a rectangular steel frame including five spaced, relatively shorter, parallel rectangular tube members 17.1 and two longer members 17.2 interconnecting the free ends of the shorter members 17.1. A peripheral downwardly extending flange is provided on the lid by right angled members 17.3 welded to the frame to extend about the whole of the periphery of the lid. A pressed wood member 17.4 is mounted on the frame by screws 17.5 extending into frame members 17.1 and 17.2 to cover the frame. An annular seal 17.6 is provided to extend about the whole periphery of lid 17 in channel 17.7 defined between the members 17.1 or 17.2 and downwardly extending flange 17.3.

As best shown in FIG. 7*a*, lid 17 seats on the inwardly extending legs of right angled frame member 16.7 and its corresponding members on walls 12, 13 and 15. As explained hereinbefore, with reference to wall 12, right angled member 16.7 is mounted on post 16.6 of second wall member 16.2 of wall 16.

Lid 17 is secured on the container side walls 15 and 16 by bolts 17.8 co-operating with nuts 17.9 welded to an inside wall of rectangular tube frame member 17.2.

Figure 3A:
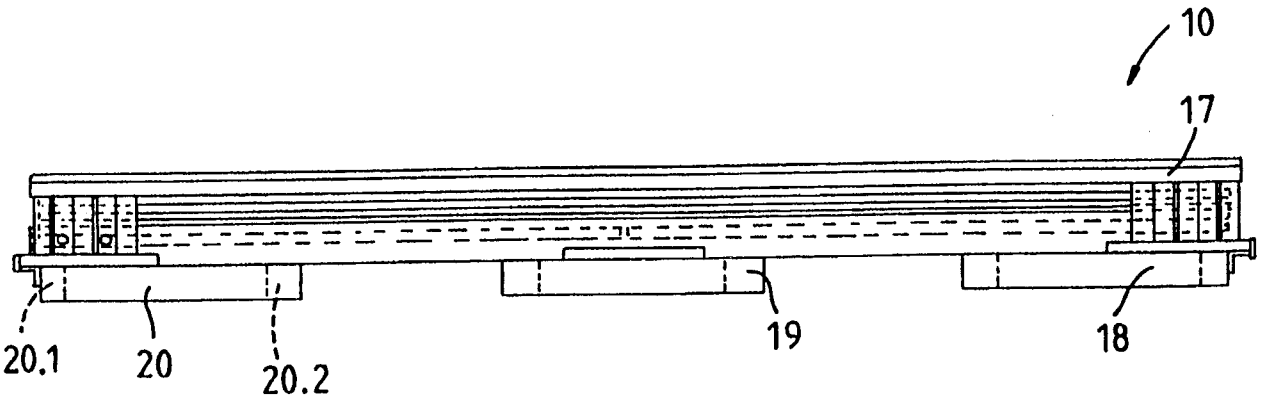
FIG. 3*a*: is a diagrammatic side view of the collapsible container according to the invention in its collapsed or knocked down condition.
Figure 3B:
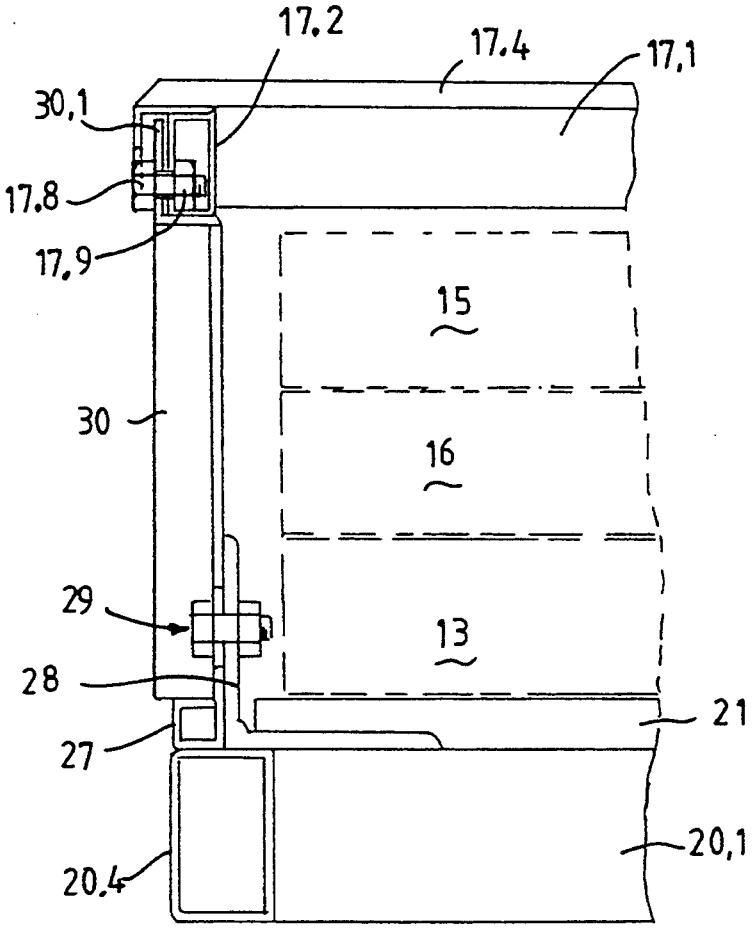
FIG. 3*b*: is a diagrammatic enlarged and broken away view of the container according to the invention in its collapsed or knocked down condition.

The container is shown in its collapsed condition in FIGS. 3*a* and 3*b*. Wall members 12.2 and 13.2 are manipulated to their aforementioned first configurations wherein members 13.1 and 13.2 as well as 12.1 and 12.2 are facing one another. These walls are then folded down onto base 11 to lie next to one another with each covering approximately half the area of base 11. Side walls 15 and 16 are removed from base 11 by loosening bolts 29 in FIG. 6. These walls are then positioned on top of one another and on top of walls 12 and 13. Lid 17 is then located on top of the stack.

As shown in FIG. 3*b* a pillar 30 is mounted on base 11 by means of bolts 29 and right angled member 28. Lid 17 is also secured to pillar 30 by means of bolt 17.8 extending through a hole in flange 30.1 of pillar 30 and cooperating with nut 17.9 in frame member 17.2. The container 10 in its collapsed condition is therefore a compact unit and many of these collapsed containers may be stored in a normal twelve meter ship container.

To assemble the container 10, lid 17 is first removed and walls 15 and 16 are lifted from the stack. Walls 12 and 13 are moved towards their upright positions and second wall members 12.2 and 13.3 are manipulated towards a desired height wherein the container will have the desired size.

Goods to be transported in the container may now be put on base 11. Side walls 15 and 16 are then mounted on base 11 and secured to the base and walls 12 and 13. Finally lid 17 is mounted on the walls as hereinbefore described.

It will be appreciated that there may be many variations in detail on the collapsible container according to the invention without departing from the scope and spirit of the appended claims.

We claim:

1. A collapsible container comprising:

a rectangular base;

a plurality of walls including a first and a second end wall;

each wall of said plurality of walls being manipulatable relative to the base between a first collapsed position wherein said each wall lies flat on the base and a second assembled position wherein said each wall rises from the base;

said each wall comprising at least two rectangular wall members slidingly connected to one another so that the members may slidingly be manipulated to adjust the height of the wall;

a lid mountable on the walls to close the container;

said first and said second end wall being hinged by a first and a second hinge respectively to a first and a second end of the base so that said first and second end wall are manipulatable between said first position and said second position, the base comprising at least one rectangular formation of which two opposed limbs, which are rectangular in cross section, extend along said first and said second end of the base; wherein a first right angled member is secured to one of said two opposed limbs with one leg of the first right angled member abutting against a side wall of the limb and another leg of the first right angled member extending outwardly away from the limb; wherein a second right angled member is also secured to said one of said two opposed limbs in partially overlapping relation relative to the first right angled member with one leg of the second right angled member abutting against a top wall of said one of said two opposed limbs and also against said another leg of the first right angled member and with its other leg extending upwardly away from the base; wherein one leg of said first hinge is secured to the said other leg of the second right angled member and another leg of said first hinge is secured to said first end wall of the container; and wherein a support for said first end wall is secured in a rebate defined between said another leg of the first right angled member and said other leg of the second right angled member.

2. A collapsible container as claimed in claim 1 wherein two separate side walls are mountable on the base between said first and said second end walls.

3. A collapsible container as claimed in claim 2 wherein the base is in the form of a pallet.

4. A collapsible container as claimed in claim 1 wherein a downwardly extending member is secured to the support for said first end wall to extend beyond said another leg of the first right angled member thereby to define with said one and said another legs of the first right angled member an inverted channel wherein a sling of a crane may be received.

5. A collapsible container as claimed in claim 1, wherein said at least two rectangular wall members of each wall comprises first and second rectangular wall members, each said rectangular wall member including a frame comprising a plurality of spaced posts cladded with a sheet, the posts of the second rectangular wall member being telescopically movable in corresponding posts of the first rectangular wall member so that the first and the second wall members can be slidingly manipulated relative to one another to adjust the height of the wall.

6. A collapsible container as claimed in claim 5 wherein the first rectangular wall member is erectable on the base and the second rectangular wall member is slidingly connected to the first wall member and wherein the posts of the first wall member are of top-hat configuration and the posts of the second wall member are rectangular tubular members telescopically movable in the posts of the first wall member.

7. A collapsible container as claimed in claim 5 wherein the posts define spaced apertures and wherein said first and said second rectangular wall members can be locked in a desired configuration relative to one another by locking elements extending through registering apertures in the posts.

8. A collapsible container as claimed in claim 2 wherein said first and second end walls are folded down onto the base to lie adjacent one another, wherein said side walls are located on said end walls and wherein the lid is located on the side walls and secured to the base by a formation extending between the lid and the base when said container is in said collapsed position.

9. A collapsible container as claimed in claim 8 wherein the formation comprises a pillar securable to the base by means for securing said side walls on the base in said assembled position and to the lid by means for securing the lid on said side walls in said assembled position.

10. A collapsible container comprising a rectangular base, a plurality of walls erectable on the base to rise therefrom and a lid mountable on the walls to close the container; the base comprising at least one rectangular formation supporting a floor, the formation comprising two opposed limbs which are rectangular in cross section and which extend along opposed ends of the base; a first right angled member secured to one of said two opposed limbs with one leg of the first right angled member abutting against a side wall of said one limb and another leg of the first right angled member extending outwardly away from said one limb; a second right angled member secured to said one limb in partially overlapping relation relative to said first right angled member, one leg of the second right angled member abutting against a top wall of said one limb and also against the said another leg of the first right angled member and an other leg of said second angled member extending upwardly away from the base; a hinge of which one leg secured to the said other leg of the second right angled member while another leg of the hinge is secured to an end wall of the container; and a support for the end wall secured in a rebate defined between said another leg of the first right angled member and said other leg of the second right angled member.

* * * * *